US005290150A

United States Patent [19]

Takahashi et al.

[11] Patent Number: 5,290,150

[45] Date of Patent: Mar. 1, 1994

[54] SCREW ROTOR COMPRISING A PLURALITY OF THIN PLATES

[75] Inventors: Tsutomu Takahashi; Shuhei Nakahama, both of Tokyo, Japan

[73] Assignee: Ebara Corporation, Tokyo, Japan

[21] Appl. No.: 961,524

[22] Filed: Oct. 15, 1992

[30] Foreign Application Priority Data

Oct. 17, 1991 [JP] Japan ..... 3-298373

[51] Int. Cl.[5] ..... F04C 2/08

[52] U.S. Cl. ..... 416/229 R; 418/201.1

[58] Field of Search ..... 416/229 R, 176; 418/201.1

[56] References Cited

U.S. PATENT DOCUMENTS

| | | | |
|---|---|---|---|
| 885,109 | 4/1908 | Truss | 416/229 |
| 2,325,617 | 8/1943 | Lysholm et al. | 74/466 |
| 2,349,022 | 5/1944 | Ungar et al. | 418/201.1 |
| 2,362,106 | 11/1944 | Ungar et al. | 418/201.1 |
| 3,918,838 | 11/1975 | Moody, Jr. et al. | 416/229 R |

FOREIGN PATENT DOCUMENTS

| | | | |
|---|---|---|---|
| 893890 | 7/1949 | Fed. Rep. of Germany . | |
| 1703835 | 2/1972 | Fed. Rep. of Germany . | |
| 1164419 | 10/1958 | France . | |
| 1323003 | 2/1963 | France . | |
| 260804 | 11/1926 | United Kingdom . | |
| 11410 | 8/1988 | United Kingdom | 416/176 |

OTHER PUBLICATIONS

Patent Abstracts of Japan, vol. 7, No. 124 (M-218), May 28, 1983, & JP-A-58-041-670, Mar. 10, 1983, M. Kuragano.

Patent Abstracts of Japan, vol. 7, No. 124 (M-218), May 28, 1983, & JP-A-58-041-634, Mar. 10, 1983, M. Kuragano.

Journal of Materials Process Technology, Nov. 1986, pp. 1-9, Nakagawa, et al., "Attempts to Manufacture Materials by Laminating Thin Plates".

*Primary Examiner*—Edward K. Look
*Assistant Examiner*—Michael S. Lee
*Attorney, Agent, or Firm*—Oblon, Spivak, McClelland, Maier & Neustadt

[57] ABSTRACT

A screw rotor for use in a hydraulic machine which has a pair of rotors engageable with each other to compress fluid, pump fluid or expand fluid, and a method of manufacturing such a screw rotor. The screw rotor comprises a shaft, a screw body including a number of stacked thin plates bonded with one another, and a cavity provided in the screw body and formed by openings of the stacked thin plates. The method of manufacturing a screw rotor comprises the steps of preparing a number of thin plates having at least one opening, stacking the thin plates in such a manner that a through hole of the thin plate receives a shaft, filling a cavity formed by the openings of the stacked thin plates with powdery pressure medium, and bonding the stacked thin plates with one another by diffusion bonding under a hot isostatic pressing process.

4 Claims, 11 Drawing Sheets

SCREW ROTOR COMPRISING A PLURALITY OF THIN PLATES

BACKGROUND OF THE INVENTION

1. Field of the Invention

The present invention relates to a screw rotor and a method of manufacturing the same, and more particularly to a screw rotor for use in a hydraulic machine which has a pair of rotors engageable with each other to compress fluid, pump fluid or expand fluid, and a method of manufacturing such a screw rotor.

2. Description of the Prior Art

There has been known a screw type of hydraulic machine in which a pair of screw rotors comprising a female rotor and a male rotor are engaged with each other and rotated in a casing, whereby fluid confined in cavities defined between outer surfaces of the screw rotors and an inner surface of the casing is transferred in an axial direction from one end of the screw rotors to the other end thereof, thus compressing fluid or pumping fluid.

In a screw rotor for use in a supercharger of an automobile or a compressor of an aircraft, there has been a strong requirement for reducing weight and moment of inertia thereof. To meet this requirement, there has been proposed a hollow screw rotor in, for example, Laid-Open utility model publication No. 63-198401. The hollow screw rotor disclosed in Laid-Open utility model publication No. 63-198401 is formed by a drawing process, an extruding process or a investment casting.

However, the screw rotor manufactured by the drawing process or the extruding process has the following drawbacks:

(1) It is impossible to manufacture a screw rotor having a large helix angle.

(2) A screw rotor having a uniform helix angle and which is accurate cannot be formed.

(3) A screw rotor having a uniform thickness cannot be manufactured, which results in a deterioration of a dynamic balance.

(4) A screw rotor having small rounded corners or sharp corners on outer and inner surfaces thereof cannot be configured.

(5) A screw rotor having a thin thickness cannot be manufactured, thus failing to reduce weight and moment of inertia of the screw rotor.

(6) The material to be used for a screw rotor is restricted because malleability is indispensable for the material.

On the other hand, the screw rotor manufactured by the investment casting is also problematic in that it is expensive in a manufacturing cost and is not suitable for mass production because of its difficulty of removing sand from a product.

SUMMARY OF THE INVENTION

It is an object of the present invention to provide a screw rotor whose weight and moment of inertia ca be reduced.

Another object of the present invention is to provide a method of manufacturing a screw rotor by HIP (Hot Isostatic Pressing) process.

According to one aspect of the present invention, there is provided a screw rotor for use in a hydraulic machine comprising: a shaft; a screw body supported by the shaft and including a number of stacked thin plates each having the same outer profile and at least one opening, the stacked thin plates being bonded with one another; and a cavity provided in the screw body and formed by the openings of the stacked thin plates.

In accordance with the present invention, the screw body can be formed by stacking a number of thin plates each having an opening and by bonding them with one another and the cavities can be formed in the interior of the screw body by the openings of the stacked thin plates. Therefore, the screw rotor having a thin thickness can be manufactured, thus enabling weight and moment of inertia to be reduced.

According to another aspect of the present invention, there is provided a method of manufacturing a screw rotor for use in a hydraulic machine comprising the steps of: preparing a number of thin plates each having the same outer profile and at least one opening, the thin plate further having a through hole for receiving a shaft at a center portion thereof; stacking the thin plates in such a manner that the through hole of the thin plate receives the shaft; filling a cavity formed by the openings of the stacked thin plates with powdery pressure medium; and bonding the stacked thin plates with one another by diffusion bonding under a hot isostatic pressing process.

In accordance with the present invention, the screw rotor can be manufactured by stacking thin plates each having an opening, filling the cavity formed by the openings of the stacked thin plates with powdery pressing medium, and processing the stacked thin plates in the furnace by the HIP process. Therefore, the screw rotor is not expensive in manufacturing cost and is suitable for mass production. It is possible to manufacture a screw rotor having a large helix angle and which is accurate.

The above and other objects, features and advantages of the present invention will become more apparent from the following description when taken in conjunction with the accompanying drawings in which a preferred embodiment of the present invention is shown by way of an illustrative example.

DETAILED DESCRIPTION OF THE PREFERRED EMBODIMENT

Figure 1:
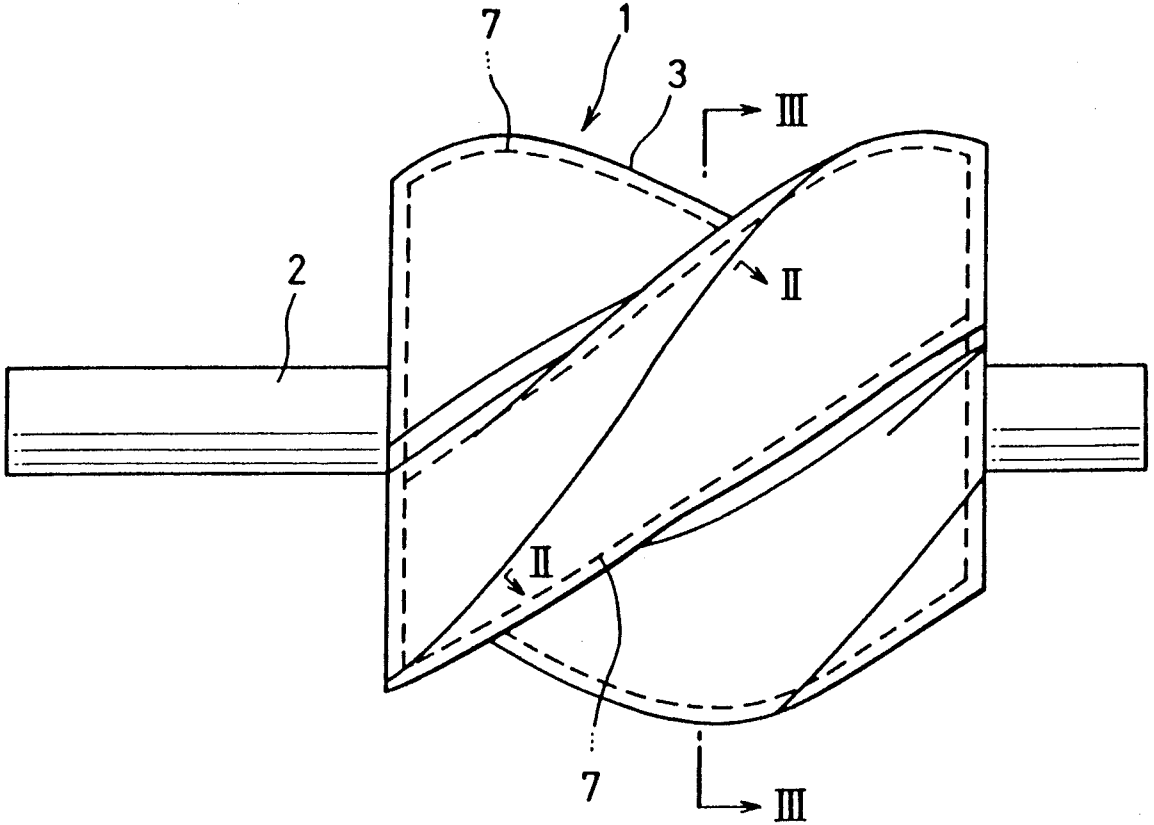
FIG. 1 is a plan view of a screw rotor according to an embodiment of the present invention.

A screw rotor and a method of manufacturing the same of the present invention will be described below with reference to FIGS. 1 through 9.

FIGS. 1 through 4 show a screw rotor comprising a plurality of thin plates having a bifoliate shape and laminated with one another. A screw rotor 1 comprises a screw body 3 having a screw-shaped outer configuration and a rotating shaft 2 for supporting the screw body 3.

Figure 2:
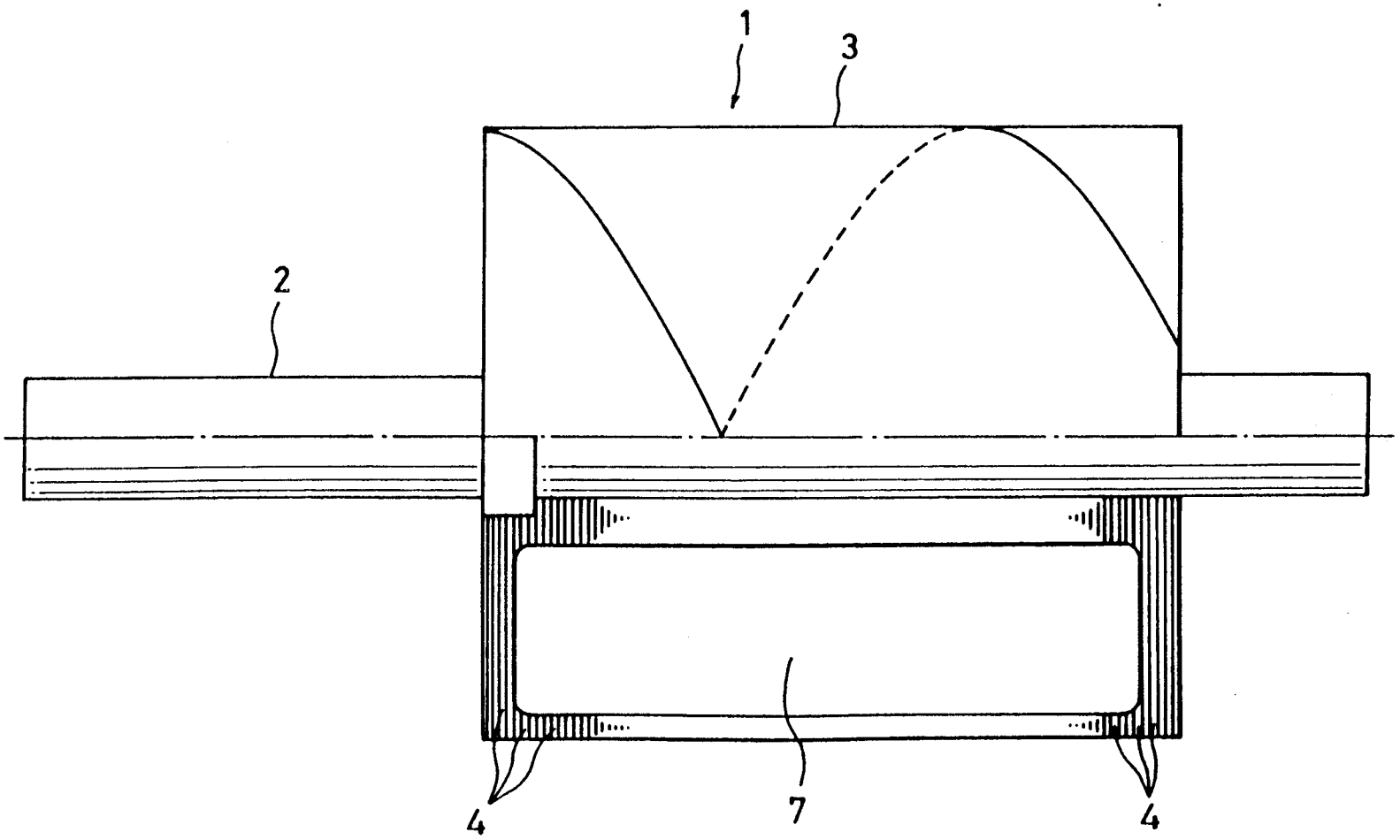
FIG. 2 is a front view with partially cross-sectioned view, the cross-sectioned view being taken along the ridge line II—II of the screw rotor in FIG. 1.
Figure 3:
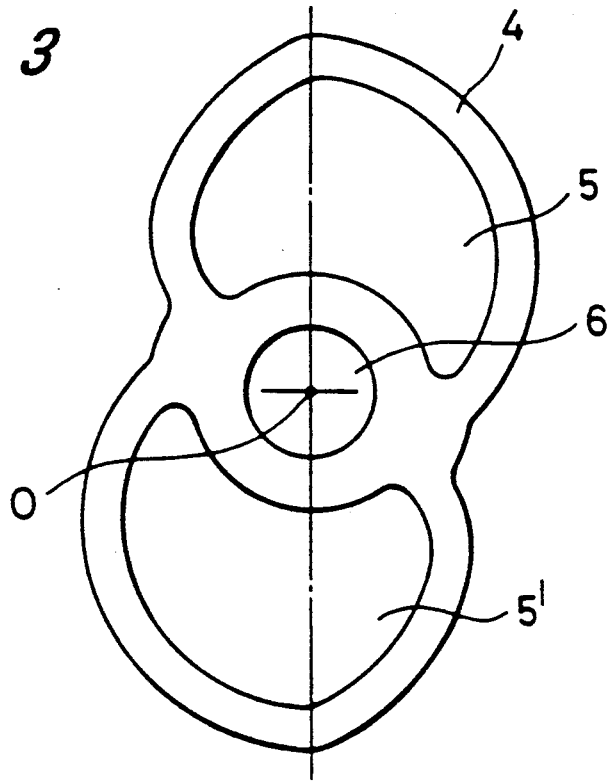
FIG. 3 is a cross-sectional view taken along the line III—III of FIG. 1.
Figure 4:
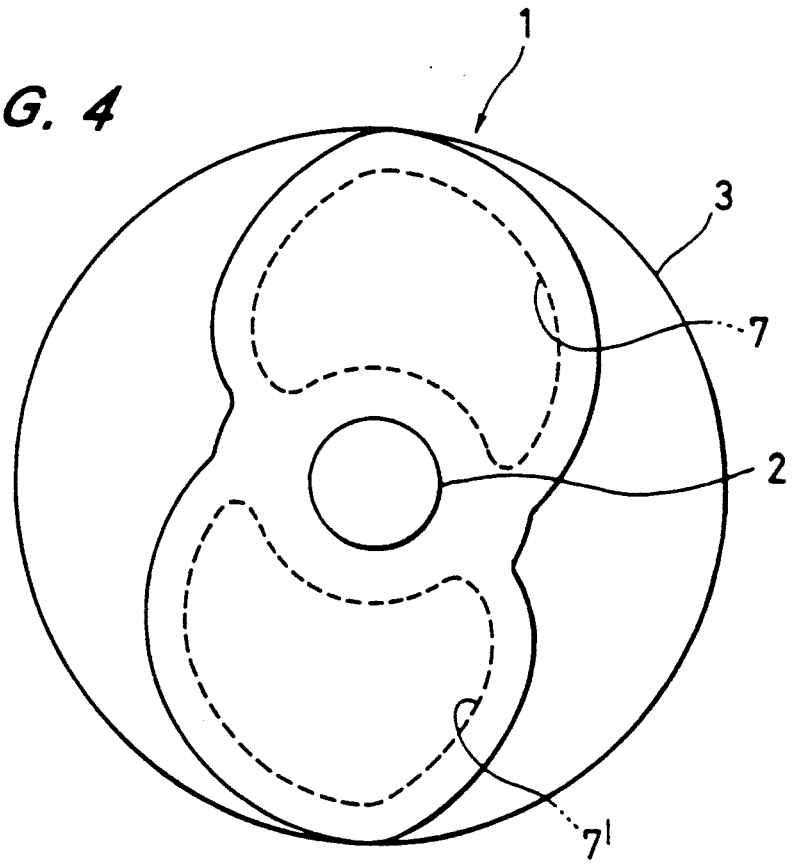
FIG. 4 is a side view of a screw rotor according to the embodiment of the present invention.

The screw body 3 is formed of a number of thin plates stacked and bonded with one another as shown in FIG. 2. To be more specific, the thin plate 4 is in the form of cocoon and has therein openings 5, 5' and a through hole 6 as shown in FIG.3. When laying a subsequent thin plate 4 on the end of a preceding thin plate 4, the subsequent thin plate 4 is superposed so as to have a certain phase difference relative to the preceding thin plate 4 by rotating the subsequent thin plate 4 around a center 0 thereof by a predetermined angle with respect to the preceding thin plate 4. By stacking a number of thin plates 4 so as to form a certain phase difference between two adjacent thin plates 4, a screw-shaped outer profile of the screw body 3 is formed and two screw-shaped cavities 7 are formed in the screw body 3 as shown in FIGS. 1 and 4. The rotating shaft 2 is inserted into the through holes 6 of the stacked thin plates 4 and connected to the stacked thin plates 4.

Further, a plurality of the thin plates 4 positioned at at least one end of the screw body 3 are formed of solid material having no opening, and thus the screw rotor 3 has at least one end enclosed.

Next, a method of manufacturing a screw rotor having the above structure will be described below with reference to FIGS. 5 through 9.

Figure 5:
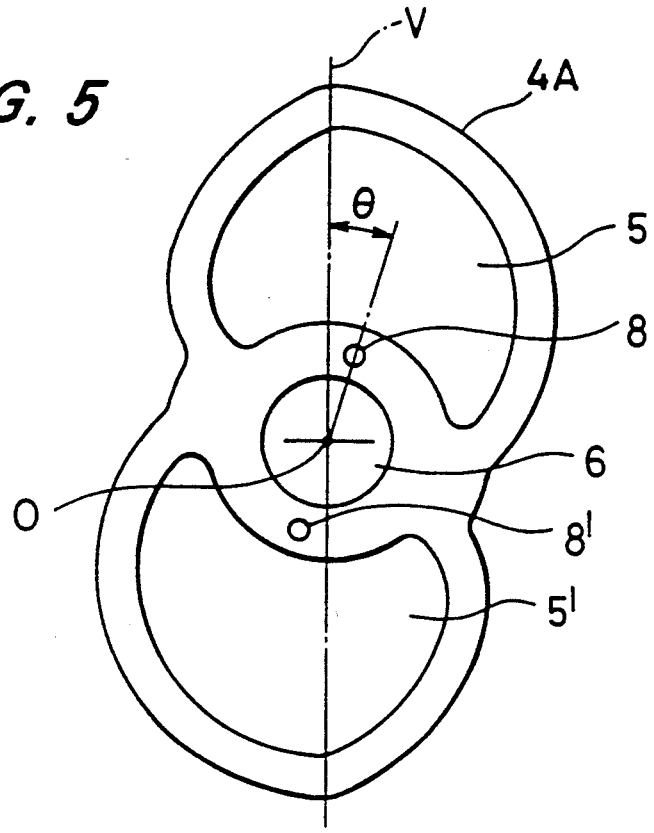
FIG. 5 is a side view showing a thin plate incorporated in the screw rotor according to the embodiment of the present invention.
Figure 6:
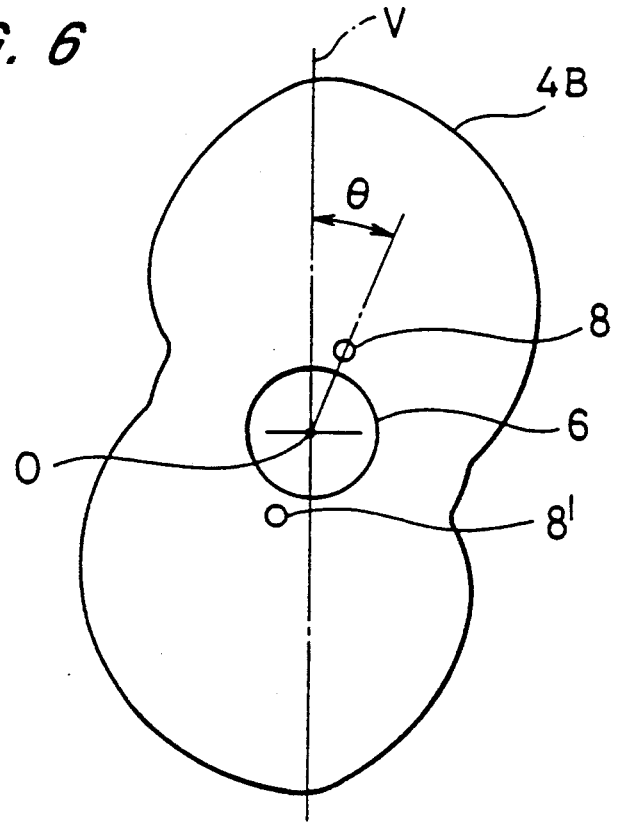
FIG. 6 is a side view showing a thin plate incorporated in the screw rotor according to the embodiment of the present invention.

First, a predetermined number of thin plates 4A each having openings 5, 5' and a through hole 6 are formed by a blanking process or a laser machining as shown in FIG. 5. A predetermined number of thin plates 4B each having only a through hole 6 and made of substantially solid material are formed by a blanking process or a laser machining as shown in FIG. 6. Simultaneously with or after forming the thin plates 4A, 4B by the blanking process or the laser machining, a pair of diametrically opposed holes 8, 8' are formed at a position slightly apart from the through hole 6, the holes 8, 8' being formed for positioning the thin plate 4.

The position of holes 8, 8' formed on each thin plate 4A, 4B is different from each other. To be more specific, the angle ($\theta$) between a reference line V extending vertically from the center O and a line extending from the center O and passing through the hole 8 is arranged so as to increase by a predetermined angle as the thin plates 4 are stacked. The predetermined angle to be increased corresponds to the angle which is obtained by dividing the total helix angle by the number of the stacked thin plates. For example, assuming that the total helix angle is 250° and the number of the stacked thin plates is 250, the angle to be increased is 1° and the angle ($\theta$) set at the angle which is increases by 1° as the thin plates are stacked. Although a pair of holes 8, 8' are provided in the embodiment, only one hole 8 or 8' may be provided. Further, a key way may be provided adjacent to the through hole 6 instead of the holes 8, 8'.

Figure 7:
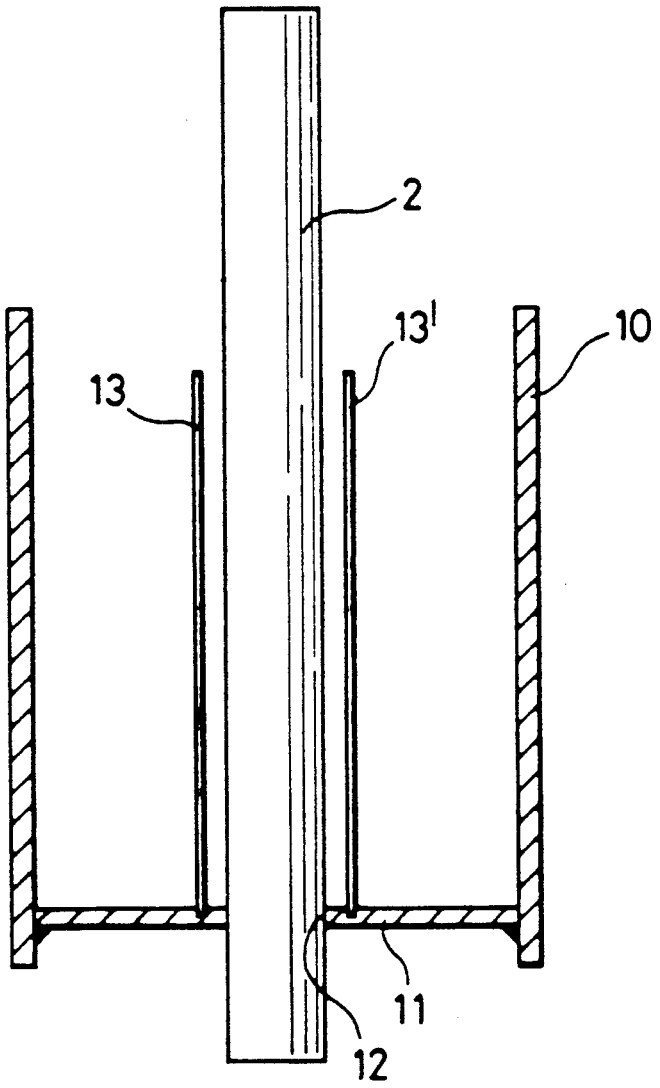
FIG. 7 is an explanatory view showing a process for manufacturing the screw rotor of the present invention.

Next, a container 10 is prepared as shown in FIG. 7. The container 10 has a bottom plate 11 having a through hole 12 and a pair of pins 13, 13' vertically provided thereon. The pins 13, 13' do not pierce through the bottom plate 11. The rotating shaft 2 is fitted with the through hole 12 of the bottom plate 11. It goes without saying that in case of one positioning hole 8 or 8' one positioning pin 13 or 13' is provided.

Figure 8:
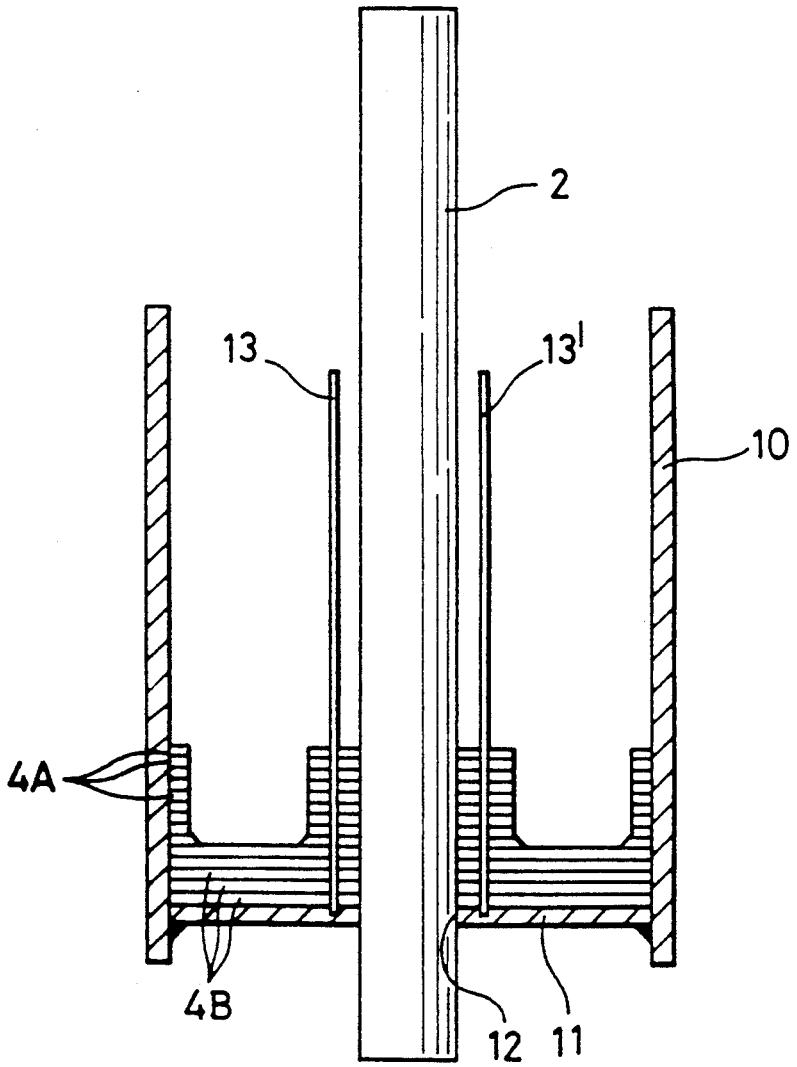
FIG. 8 is an explanatory view showing a process for manufacturing the screw rotor of the present invention.

Next, a predetermined number of thin plates 4B (see FIG.6) having no opening are stacked as shown in FIG. 8, and then a predetermined number of thin plates 4A (see FIG.5) having openings 5, 5' are stacked as shown in FIG.8. When stacking these thin plates 4B, 4A, the holes 8, 8' of the thin plates 4B, 4A are fitted with the pins 13, 13', thereby positioning the stacked thin plates 4B, 4A. Thereafter, a predetermined number of thin plates 4C which are formed by forming holes 9, 9' with a small diameter on the thin plate 4B (see FIG.6) are stacked as shown in FIG. 9, whereby a screw-shaped outer profile of the screw body 3 is formed and two screw-shaped cavities 7, 7' are formed in the screw body 3.

Figure 9:
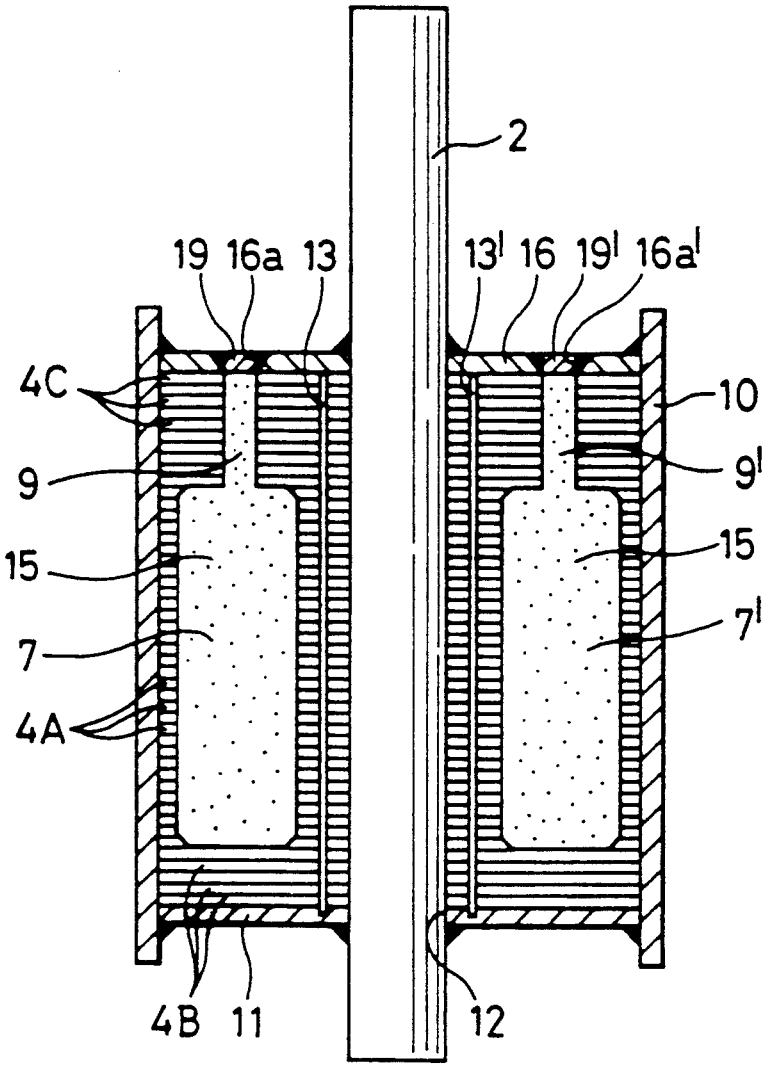
FIG. 9 is an explanatory view showing a process for manufacturing the screw rotor of the present invention.

Next, an upper plate 16 is placed on the top of the stacked thin plates 4C, and then ceramics powder 15 is charged into the cavities 7, 7' from openings 16*a* formed on the upper plate 16 and holes 9, 9' formed on the thin plates 4C as shown in FIG.9. Further, the ceramics powder is charged into a space between the inner periphery of the container 10 and the outer periphery of the screw body 3.

The ceramics powder having such property as not to be sintered by the HIP process is selected. For example, alumina or silicon carbide is suitable as ceramics powder. This ceramics powder serves as powdery pressure medium which applies pressure to the object (screw rotor) to be processed by the HIP process.

Next, plugs 19, 19' are fitted with the openings 16*a*, 16*a*' of the upper plate 16 as shown in FIG. 9, and then the clearance between the plugs 19, 19' and the openings 16*a*, 16*a*' are sealed by welding or blazing. Further, the clearance between the upper plate 16 and the container 10 and the clearance between the upper plate 16 and the rotating shaft 12 are sealed by welding or blazing. Incidentally, before sealing the openings 16*a*, 16*a*' of the upper plate 16, air may be discharged from the enclosed container 10 as much as possible under vacuum to prevent oxidization of the thin plates 4 and deterioration of material.

Next, the sealed container 10 is entered into a HIP processing apparatus (not shown) to carry out the HIP process. The HIP process is a process which utilizes the synergistic effect of high pressure (several hundreds—2000 kgf/cm$^2$) and high temperature (several hundreds—2000° C.) using a gas such as argon in a pressure tank incorporating therein a heating furnace. At this time, temperature, pressure and treatment time in the HIP process are suitably selected in accordance with material of the thin plates or the like. By the HIP process, the stacked thin plates 4 are bonded with one another by diffusion bonding, and the thin plates 4 and the rotating shaft 2 are bonded by diffusion bonding as well. This diffusion bonding by the HIP process enables the bonding portion to be bonded perfectly and to form fine structure.

After finishing the HIP process, the container 10 and the upper plate 16 are removed by machining or the like. Thereafter, the ceramics powder 15 is taken out of the cavities 7, 7' using the holes 9, 9' of the thin plates 4C. Finally, the outer surface of the screw body 3 is finished by machining.

A hollow screw rotor made of thin plates is formed by way of the above processes. After taking out the ceramics powder from the cavities 7, 7', the holes 9, 9' may be sealed off using plugs or the like. In the embodiment, the enclosed wall is formed at one end of the screw rotor, however, the enclosed wall may be formed at the intermediate portion of the screw rotor by providing the thin plates 4B at the intermediate portion of the stacked thin plates. In the case where a wall is formed at the intermediate portion of the screw rotor, it is easy to take out the powdery pressure medium from the cavities after the HIP process.

A screw rotor can be manufactured by a uniaxial pressing type of diffusion bonding which performs diffusion bonding while applying a uniaxial pressure to an object to be bonded. However, in the uniaxial pressing type of diffusion bonding, the stacked thin plates can be bonded in only a direction perpendicular to the pressure. Therefore, after the stacked thin plates are bonded with one another, the shaft must be bonded to the thin plates separately. In contrast, in case of manufacturing the screw rotor by the HIP process, bonding surfaces in multiple directions can be bonded at a time because of an isostatic pressing by the HIP process. Therefore, the stacked thin plates are bonded together and the shaft and the this plates are bonded together, simultaneously.

Further, in case of manufacturing the screw rotor by the uniaxial pressing type of diffusion bonding the gap is easily formed between two adjacent thin plates to thus cause defective bonding because of a uniaxial pressing. On the other hand, in case of the HIP process, the gap cannot be easily formed between two adjacent thin plates, thus the thin plates can be uniformly bonded because of its isostatic pressing.

Further, in case of manufacturing the screw rotor by the uniaxial pressing type of diffusion bonding, bonding work must be carried out one by one under pressing. In contrast, since the HIP process enables a number of screw rotors to process in the furnace at a time, it is suitable for mass production.

Furthermore, according to the HIP process, since high pressure can be uniformly applied to the bonding surfaces, the screw rotor can be reliably manufactured without using insert material.

Figure 10:
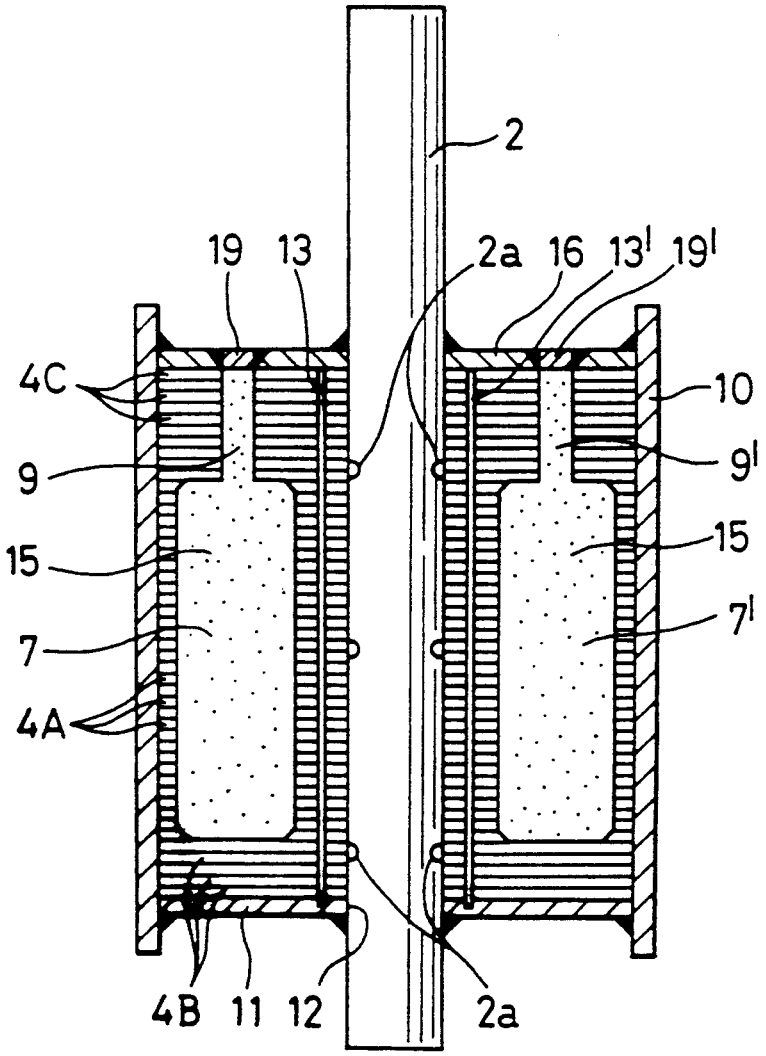
FIG. 10 is an explanatory view showing another process for manufacturing the screw rotor of the present invention.

FIG. 10 shows another embodiment of the present invention in which the rotating shaft 2 is formed with a plurality of recesses 2*a* on the outer periphery thereof. By forming recesses 2*a* in advance on the outer periphery of the rotating shaft 2, the inner periphery of the thin plates 4 is projected to the recesses 2*a* by the HIP process, thus improving bonding strength of the thin plates 4 and the shafts 2. Incidentally, the number of recesses is outside of the question, one recess 2*a* may be enough to improve the bonding strength to some degree.

Figure 11:
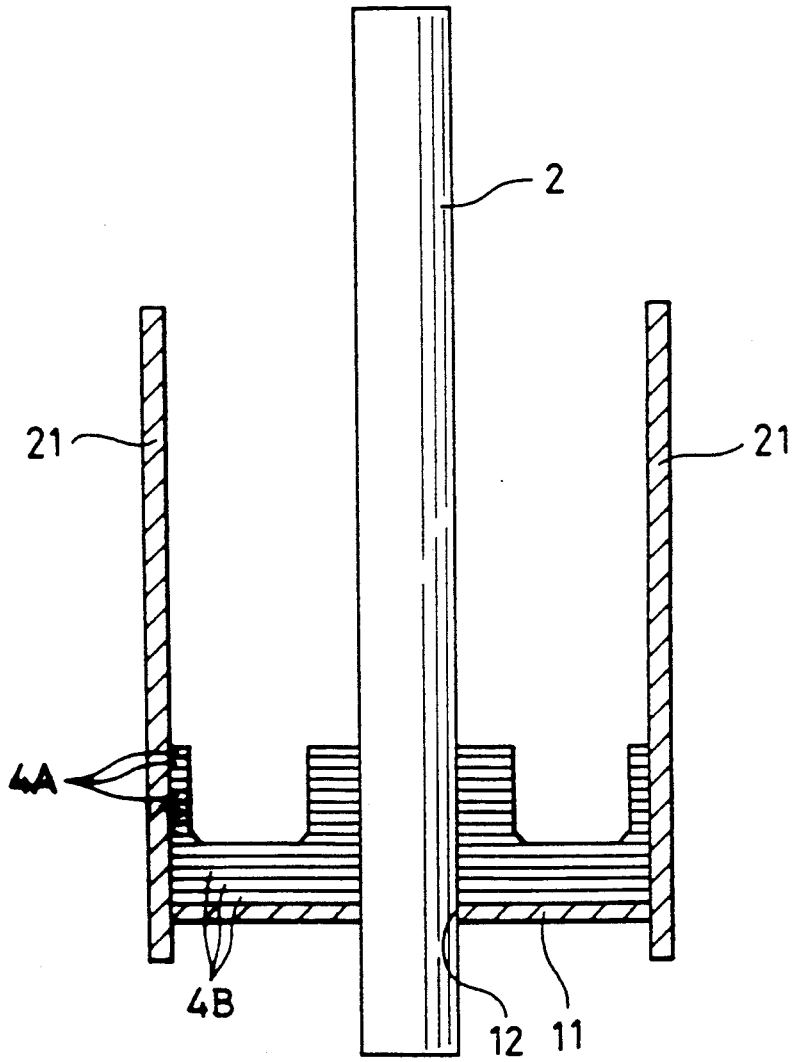
FIG. 11 is an explanatory view showing still another process for manufacturing the screw rotor of the present invention.

FIG.11 shows an example in which the stack of thin plates and positioning of the thin plates can be carried out without using a pin for positioning. To be more specific, a jig 21 comprising a plurality of split members has an inner periphery corresponding the outer profile of the screw rotor. Therefore, the configuration of the screw rotor can be formed only by the stack of the thin plates 4A, 4B as shown in FIG.11. After the stack of thin plates, the jig 21 is removed therefrom, and the stacked thin plates and the shaft are accommodated in the container. Thereafter, the ceramics powder is charged into the cavities of the screw body and between the screw body and the container. Finally, the HIP process is applied to them to manufacture the screw rotor.

Figure 12:
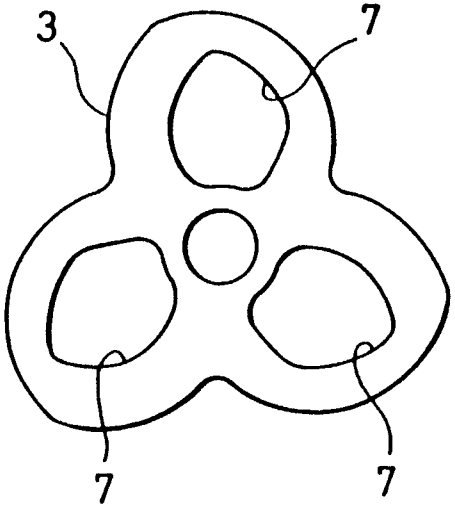
FIG. 12(*a*) and 12(*b*) are views showing a screw rotor according to another embodiment of the present invention, FIG. 12(*a*) is a plan view of the screw rotor and FIG. 12(*b*) is a cross-sectional view taken along the line XII(*b*)—XII(*b*) of FIG. 12(*a*)
Figure 12:
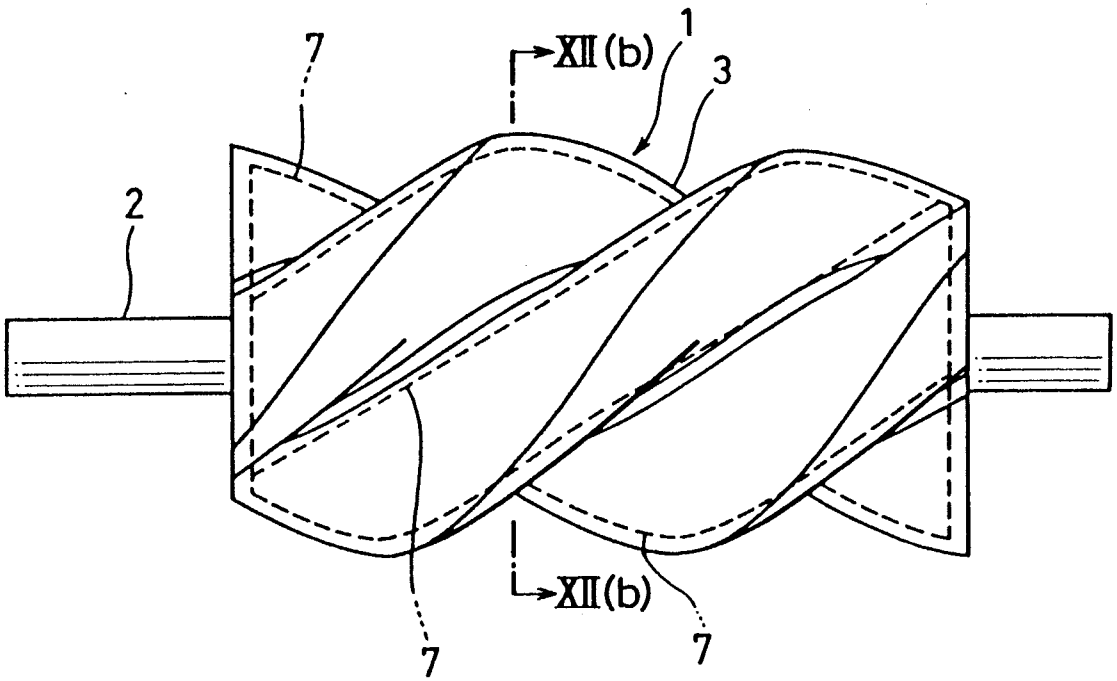

FIG. 12 shows a screw rotor which is formed by stacking thin plates each having a trifoliate shape. A method of manufacturing the screw rotor in FIG. 12 is the same as the above embodiments in FIGS. 5 through 11.

Next, another embodiment of a method of manufacturing a screw rotor will be described below with reference to FIG. 13. After sealing the gap between two adjacent thin plates of the stacked thin plates 4A, 4B, 4C by sealing means, the stacked thin plates 4A, 4B, 4C are bonded with one another, and the stacked thin plates 4A, 4B, 4C and the shaft 2 are bonded with each other by diffusion bonding under the HIP process. Metal coating such as metal plating, spraying, CVD (Chemical Vapor Deposition), PVD (Physical Vapor Deposition), or welding is suitable for sealing the gap between two adjacent thin plates of the stacked thin plates as sealing means. The above metal plating includes nickel plating such as Kanigen plating (Catalytic nickel generation), aluminum hot dipping and the like. The spraying may be applied to the outer periphery of the stacked thin plates, and the plating may be applied to the inner periphery of the stacked thin plates.

Figure 13:
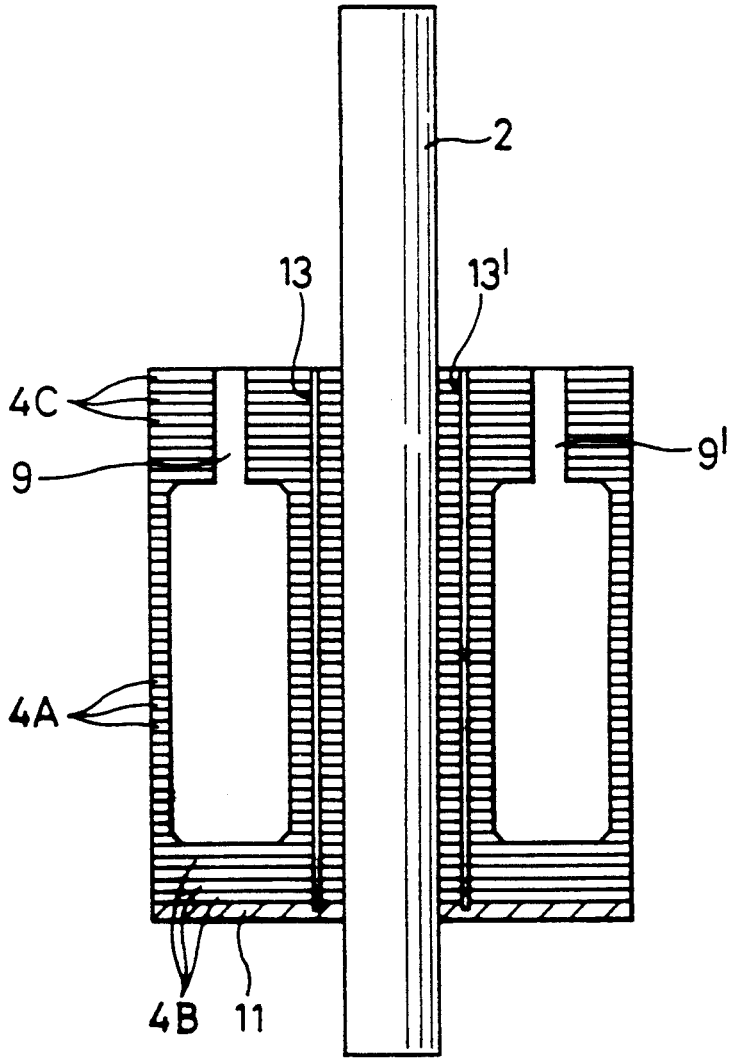
FIG. 13 is an explanatory view showing still another process for manufacturing the screw rotor of the present invention.

Further, according to modified embodiment (not shown), the outer periphery of the stacked thin plates is sealed by sealing means as shown in FIG. 13, and then the ceramics powder is charged into the cavities defined in the stacked thin plates. Thereafter, the stacked thin plates are bonded with one another, and the stacked thin plates and the shaft are bonded with each other by diffusion bonding under the HIP process.

Although applied to a mail screw rotor in the embodiments in FIGS. 1 through 13, the present invention is applicable to a female screw rotor.

As is apparent from the above description, according to the present invention, the following effects are attainable.

(1) The screw rotor having a thin thickness can be manufactured, thus reducing weight and moment of inertia of the screw rotor.

(2) The screw rotor has a good productivity and is suitable for mass production to thus reduce production cost.

(3) The screw rotor has a good accuracy, and a screw rotor having a large helix angle can be manufactured.

(4) The rotating shaft and the screw body can be integrally manufactured at a time.

(5) The screw rotor is not restricted by material to be used.

(6) In the case where the gap between two adjacent thin plates of the stacked thin plates is sealed by sealing means and powdery pressure medium is not used, it is not necessary to take out powdery pressure medium after the HIP process. In this case, deformation toward the inner side of the screw rotor is prevented, thus further improving the accuracy of the product.

Although certain preferred embodiments of the present invention have been shown and described in detail, it should be understood that various changes and modification may be made therein without departing from the scope of the appended claims.

What is claimed is:

1. A screw rotor for use in a hydraulic machine, comprising:

a shaft;

a screw body supported by said shaft, said screw body comprising a plurality of first stacked solid thin plates provided at one end of said screw body for forming an enclosed wall, a plurality of second stacked thin plates each having at least one opening and provided adjacent to said first stacked solid thin plates, and a plurality of third stacked thin plates each having a forming hole formed therein and provided adjacent to said second stacked thin plates, each of said first, second and third stacked thin plates having the same outer profile and being bonded to one another; and a cavity provided in said screw body which is defined by said opening of said second stacked thin plates.

2. The screw rotor according to claim 1, wherein a diameter of said forming holes of said third stacked thin plates is less than a diameter of said opening of said second stacked thin plates.

3. The screw rotor according to claim 1, wherein when stacking said thin plates, a subsequent thin plate is superposed so as to have a certain phase difference relative to a preceding thin plate by rotating said subsequent thin plate around a center thereof by a predetermined angle with respect to said preceding thin plate.

4. The screw rotor according to claim 3, wherein said predetermined angle corresponds to an angle which is obtained by dividing a total helix angle of said screw body by the number of said stacked thin plates.

* * * * *